United States Patent [19]

Kurokawa et al.

[11] Patent Number: 4,964,366

[45] Date of Patent: Oct. 23, 1990

[54] APPARATUS FOR THE PRODUCTION OF PHOTOCONDUCTIVE COMPONENTS FOR USE IN ELECTROPHOTOGRAPHY

[75] Inventors: Makoto Kurokawa; Yoshihide Shimoda; Shuhei Tsuchimoto, all of Nara, Japan

[73] Assignee: Sharp Kabushiki Kaisha, Osaka, Japan

[21] Appl. No.: 263,401

[22] Filed: Oct. 27, 1988

[30] Foreign Application Priority Data

Oct. 30, 1987 [JP] Japan ..... 62-277000

[51] Int. Cl.[5] ..... B05C 3/02

[52] U.S. Cl. ..... 118/429; 204/257; 204/275

[58] Field of Search ..... 118/400, 429, 26, 58; 204/257, 299 R, 299 EC, 275

[56] References Cited

U.S. PATENT DOCUMENTS

| | | | |
|---|---|---|---|
| Re. 29,073 | 12/1976 | Kinney et al. | 118/429 |
| 906,011 | 12/1908 | Greenawalt | 204/257 |
| 1,986,920 | 1/1935 | Cross | 204/257 |
| 2,114,999 | 4/1938 | Pickett et al. | 118/429 |
| 3,413,904 | 12/1968 | Friedel | 118/429 |
| 3,752,383 | 8/1973 | Allen et al. | 118/400 |
| 4,072,777 | 2/1978 | Schoenthaler | 118/429 |
| 4,107,026 | 8/1978 | Freeman | 204/299 R |
| 4,614,576 | 9/1986 | Goldstein | 204/299 R |

FOREIGN PATENT DOCUMENTS

| | | | |
|---|---|---|---|
| 0074265 | 6/1952 | Denmark | 204/257 |
| 1107134 | 5/1961 | Fed. Rep. of Germany . | |
| 2617767 | 4/1976 | Fed. Rep. of Germany . | |
| 46-40082 | 6/1968 | Japan | 118/429 |
| 61-178060 | 8/1986 | Japan . | |

OTHER PUBLICATIONS

Patent Abstracts of Japan, vol. 12, No. 25 (P-659)(2872) Jan. 26, 1988, JP-A-62 178267 (Mita Ind. Co. Ltd.) Aug. 5, 1987.

*Primary Examiner*—Willard Hoag

[57] ABSTRACT

An apparatus for the production of photoconductive components for use in electrophotography, including a coating tank that contains a certain amount of coating, the tank having a coating-supply opening, at a lower portion through which the coating is supplied to the tank, and a partition that is positioned between the inner wall of the tank and the outer wall of the electric conductor, whereby when an electric conductor to be coated is immersed in the coating and removed from the coating, occurrence of a turbulent flow of the coating in the vicinity of the electric conductor can be prevented.

6 Claims, 4 Drawing Sheets

APPARATUS FOR THE PRODUCTION OF PHOTOCONDUCTIVE COMPONENTS FOR USE IN ELECTROPHOTOGRAPHY

BACKGROUND OF THE INVENTION

1. Field of the Invention

The present invention relates to an apparatus for the production of photoconductive components for use in electrophotography, which forms uniform photoconductive layers or resin layers on an electric conductor.

2. Description of the Prior Art

In recent years, various methods by which photoconductive components for use in electrophotography are manufactured by the use of organic photoconductive materials have been proposed, an example of which is the immersion-coating method in which an electric conductor is immersed in a coating that contains photoconductive materials, resulting in a photoconductive layer on the electric conductor.

When the conventional immersion-coating method is carried out, an overflow-apparatus by which the precipitation of the coating is prevented and in which the depth that the electric conductor is immersed in the coating is maintained at a fixed level must be used. FIG. 3 shows a conventional overflow-type apparatus for the production of photoconductive components, which comprises a coating tank 3 that is filled with a coating 7, an opening 5 through which the coating 7 is supplied to the tank 3, and an overflow receiver 6 that receives the overflowed coating from the opening 9 of the tank 3. When an electric conductor 1 is immersed in the coating 7 or is removed from the coating 7, a certain amount of coating 7 overflows, causing a turbulence in the coating 7 along the surface of the electric conductor 1 and/or a lathering of the coating 7 on the surface of the coating 7, which makes it impossible to obtain a uniformly coated film on the surface of the electric conductor 1.

To overcome this problem, the electric conductor 1 is disposed within the tank 3, first, and the coating 7 is fed to the tank and then the coating 7 is removed from the tank 3, thereby completing a coating process. However, at the time of the removal of the coating from the tank, the inside of the tank is filled with the solvent vapor of the coating, which causes damage to the coated film, resulting in a nonuniform film, and/or which causes deterioration in the film characteristics.

FIG. 4 shows another conventional apparatus for the production of photoconductive components, in which a cylindrical electric conductor 52 can move in the direction of the conductor axis with regard to a coating tank 51 that is positioned around the cylindrical conductor 52 so that the coating tank touches the surface of the cylindrical conductor 52 so as to create a water-tight system therebetween. This apparatus is disadvantages in that the surface of the cylindrical conductor 52 is scratched at the time when the cylindrical conductor 52 moves in the direction of the axis of the conductor 52 with regard to the coating tank 51 so as to coat the conductor 52 with the coating 63 that is held in the tank 51. A supporting means 53 supports the cylindrical conductor 52 thereon and is designed with the same diameter as that of the conductor and must be positioned under the conductor 52 so that the axis of the conductor 52 meets that of the supporting means 53. The cylindrical conductor 52 must move until the upper portion of the supporting means 53 is positioned within the coating tank 51 and accordingly the conductor 52 and the supporting means 53 must be smoothly connected to each other, which requires complicated and difficult techniques and/or skill in practice.

SUMMARY OF THE INVENTION

The apparatus of the present invention, which overcomes the above-discussed and numerous other disadvantages and deficiencies of the prior art, comprises a coating tank that contains a certain amount of coating, said tank having a coating-supply opening, at a lower portion, through which said coating is supplied to said tank, and a partition that is positioned between the inner wall of said tank and the outer wall of said electric conductor, whereby when an electric conductor to be coated is immersed in said coating and removed from said coating, occurrence of a turbulent flow of said coatings in the vicinity of said electric conductor can be prevented.

In a preferred embodiment, the partition is disposed within said tank so that the upper edge of the opening of said partition can be at a position higher than that of the upper edge of the opening of said tank from which the overflow of said coating takes place.

In a preferred embodiment, the partition has a plurality of holes, at a lower portion, through which the coating is supplied to and removed from the inside of said partition.

In a preferred embodiment, each of the holes is covered with a mesh filter.

Thus, the present invention described herein makes possible the objective of providing an apparatus for the production of photoconductive components for use in electrophotography, which regulates possible turbulence of the coating in the vicinity of the electric conductor to be coated in the coating process, resulting in a photoconductive component with a uniformly coated film.

BRIEF DESCRIPTION OF THE DRAWINGS

The present invention may be better understood and its numerous objects and advantages will become apparent to those skilled in the art by reference to the accompanying drawings as follows.

DESCRIPTION OF THE PREFERRED EMBODIMENTS

Example 1

Figure 1:
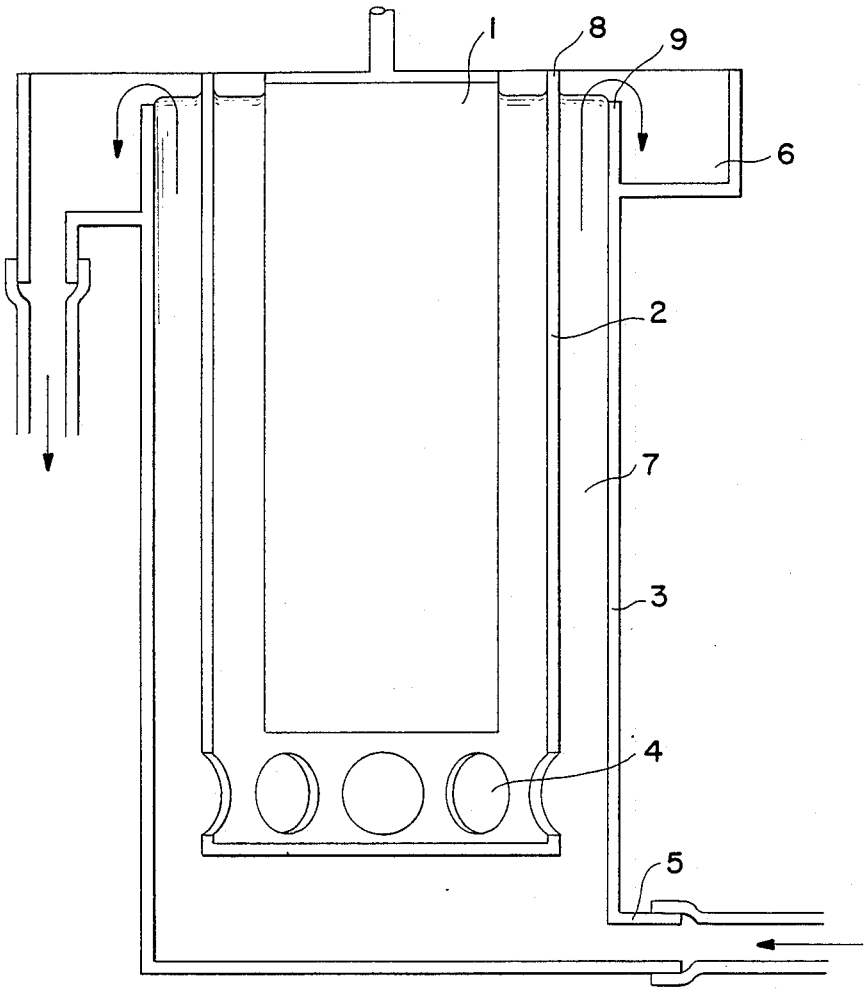
FIG. 1 is a sectional view showing an apparatus of the present invention in which an electric conductor to be coated is positioned.

FIG. 1 shows an apparatus of the present invention, which comprises a cylindrical coating tank 3 that contains a coating 7 therein, a coating-supply opening 5 for supplying the coating 7 therethrough that is positioned at a lower portion of the tank 1, an overflow receiver 6 for receiving the overflowed coating thereby that is positioned around the opening 9 of the tank 3, and a partition 2 for the prevention of possible turbulence of the coating that is positioned inside of the tank 3. The partition 2 is formed into a cylindrical shape, the inside diameter of which is larger than the outside diameter of a cylindrical electric conductor 1 to be coated with the coating 7 and the outside diameter of which is smaller than the inside diameter of the cylindrical tank 3. The cylindrical partition 2 has a plurality of holes 4, at a lower portion thereof, through which the coating 7 is supplied to and removed from the inside of the cylindrical partition 2. The cylindrical partition 2 is disposed within the cylindrical tank 3 so that the upper edge 8 of the opening of the cylindrical partition 2 can be at a position higher than that of the upper edge 9 of the opening of the cylindrical tank 3 from which the overflow of the coating 7 takes place. The position at which the upper edge 8 of the partition 2 is fixed can be adjusted depending upon the surface tension of the coating used herein. The length of the cylindrical partition 2 is preferably longer than that of the cylindrical conductor 1.

A charge-generating coating 7 is supplied to the tank 3 through the coating-supply opening 5 in such a way that a certain amount of coating 7 always overflows from the edge 9 of the tank 3 to the overflow receiver 6. The charge-generating coating 7 is prepared as follows: For example, 2 parts by weight of chloro diane blue, 1 part by weight of phenoxy resin (manufactured by Union Carbide, USA), and 97 parts by weight of 1-4-dioxane are admixed with each other and the mixture is treated within a stainless ballmill for 15 hours, resulting in a charge-generating coating.

Then, the cylindrical electric conductor 1 made of aluminum is immersed in the coating 7 of the cylindrical partition 2 that is positioned within the cylindrical tank 3. A certain amount of coating 7 that corresponds to the volume of the cylindrical electric conductor 1 is forced out of the cylindrical partition 2 through the holes 4 that are formed at the lower portion of the partition 2, and overflows from the edge 9 of the tank 3 to the overflow receiver 6. This overflow phenomenon arises outside of the cylindrical partition 2 within which the cylindrical electric conductor to be coated with the coating 7 is positioned, so that the possible turbulence of the coating 7 in the vicinity of the electric conductor 1 can be effectively reduced. Moreover, when the electric conductor 1 is removed from the coating 7, for the same reason as mentioned above, the possible turbulence of the coating 7 can be also reduced, resulting in a photoconductive layer that is uniformly formed on the electric conductor 1. The photoconductive layer is allowed to stand at room temperature for 30 minutes and then dried in a 90° C. atmosphere for 10 minutes, resulting in a charge-generating layer with a dry thickness of 0.5 μm. Then, on the charge-generating layer, a charge-transfer coating is applied in the same way as mentioned above by the use of the above-mentioned apparatus of the present invention. The charge-transfer coating is prepared as follows: One part by weight of hydrazone derivative charge-transfer agent (e.g., 4-diethylaminobenzaldehyde-N-phenyl-α-naphtylhydrazone), 1 part by weight of polycarbonate resin (Tradename; Upiron manufactured by Mitsubishi Gas Chemical Ind.), and 8 parts by weight of dichloromethane are admixed with each other, resulting in a charge-transfer coating.

Then, the electric conductor 1 with the charge-generating layer that has been coated with a charge-transfer coating is allowed to stand at room temperature for 30 minutes and then dried in a 90° C. atmosphere for 30 minutes, resulting in a charge-transfer layer with a dry thickness of 20 μm on the above-mentioned charge-generating layer. In this way, a photoconductive component that is used for electrophotography is obtained.

This photoconductive component was mounted on a copying machine and copying operation was performed with the formation of a distinct and uniform image.

Example 2

Figure 2:
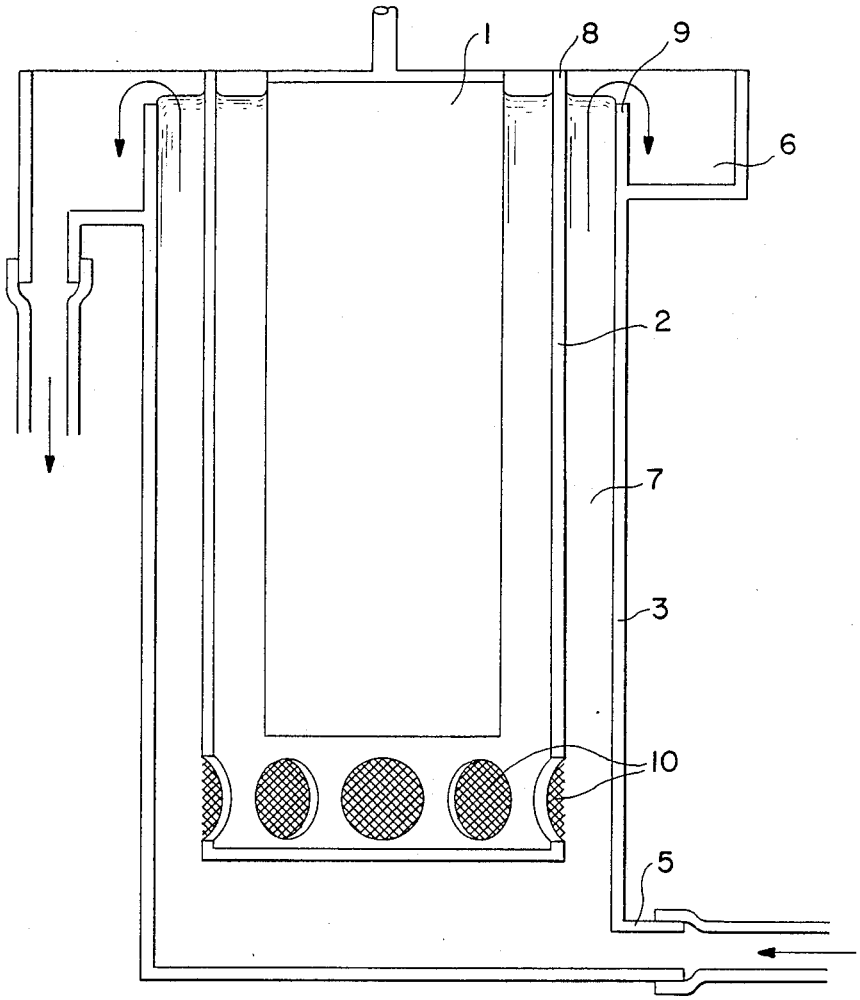
FIG. 2 is a sectional view showing another apparatus of the present invention in which an electric conductor to be coated is positioned.

FIG. 2 shows another apparatus of the present invention, which has the same structure as that of Example 1, except that each of the holes 4 is covered with a mesh filter 10 that functions to prevent extraneous components from entering the inside of the partition 2. A photoconductive component was manufactured by the use of this apparatus in the same way as that of Example 1, and mounted on a copying machine and a copying operation was performed, resulting in a distinct and uniform image, as well.

Control

Figure 3:
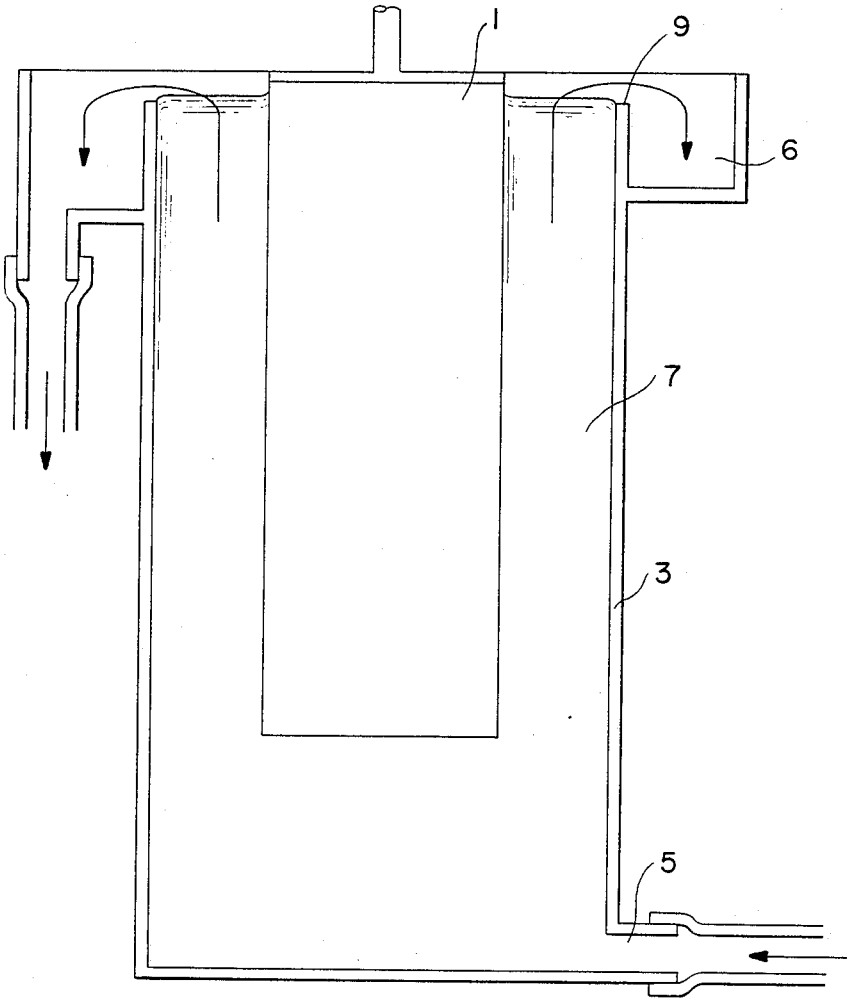
FIG. 3 is a sectional view showing a conventional apparatus in which an electric conductor to be coated is positioned.
Figure 4:
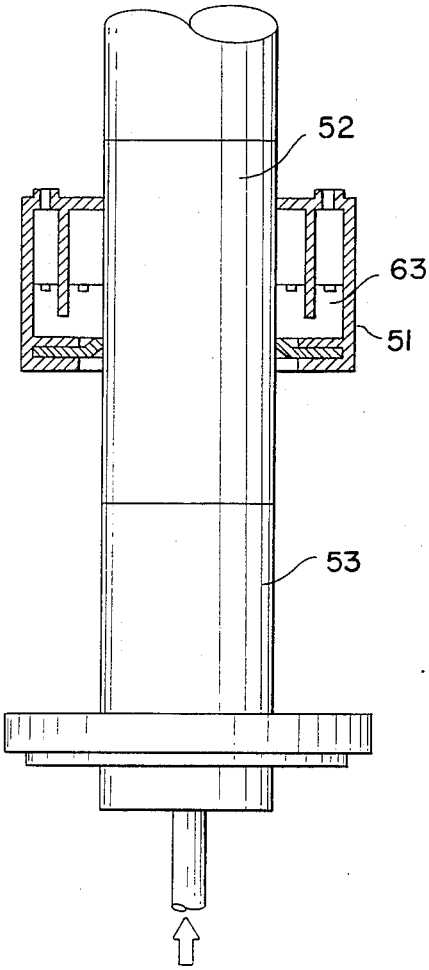
FIG. 4 is a sectional view showing another conventional apparatus by which a cylindrical electric conductor is coated.

A reference photoconductive component was manufactured in the same way as that of Example 1 by the use of a conventional apparatus such as that shown in FIG. 3 in which a cylindrical partition that functions to prevent a turbulent flow of the coating 7 in the vicinity of the cylindrical conductor 1 is not disposed within the coating tank 3. A turbulent flow of the coating 7 occurred by the overflow at the time of the immersion of the cylindrical conductor 1 into the coating 7 of the tank 3, which caused the formation of a nonuniformly coated film on the cylindrical conductor 1. The resulting photoconductive component was mounted on a copying machine and a copying operation was performed in the same way as that of Example 1, but because the photoconductive component was nonuniformly charged with static electricity, a distinct and uniform image could not be obtained.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus for the production of photoconductive components for use in electrophotography, comprising:

a coating tank having an overflow weir at a top end thereof and a coating-supply opening at a lower portion through which a coating material is supplied to said coating tank;

a chamber defined by the perimeters of the tank and communicating with said coating-supply opening;

a partition means positioned in said chamber between the inner wall of said tank and the outer surface of an electric conductor to be coated with the coating material, said partition means being provided with a plurality of holes covered with a mesh filter and disposed at a lower portion thereof through which said coating material is supplied to and removed from the inside of the partition means, whereby when an electric conductor to be coated is immersed in said coating material and removed from said coating material, the occurrence of turbulent flow being created in said coating materials in the vicinity of said electric conductor is substantially prevented.

2. The apparatus of claim 1, wherein the partition means has a cylindrical configuration.

3. An apparatus for coating an article while immersed in a coating material, said apparatus comprising:

a tank having an overflow weir at a top end thereof;

an inlet formed adjacent a bottom end of said tank;

a chamber defined by the perimeters of the tank and communicating with said inlet for receiving the coating material; and a partition formed within said chamber, said partition including a plurality of openings formed at a lower end thereof, the lower end being spaced apart from the bottom end of said tank;

wherein an upper edge of said partition is positioned higher than the overflow weir of said tank whereby turbulence created by inserting and removing the article to be coated within the confines of the partition can be substantially prevented from affecting a coating process proceeding within the chamber.

4. The apparatus according to claim 3, wherein said partition means has a plurality of holes, at a lower portion thereof through which said coating is supplied to and removed from the inside of said partition means.

5. The apparatus according to claim 3, wherein each of said holes is covered with a mesh filter.

6. The apparatus of claim 3, wherein the partition means has a cylindrical configuration.

* * * * *